US011686225B2

(12) United States Patent
Heise et al.

(10) Patent No.: US 11,686,225 B2
(45) Date of Patent: Jun. 27, 2023

(54) HARMONIC DRIVE

(71) Applicant: Schaeffler Technologies AG & Co. KG, Herzogenaurach (DE)

(72) Inventors: Daniel Heise, Herzogenaurach (DE); Marco Hildebrand, Nuremberg (DE); Bastian Hain, Creglingen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 153 days.

(21) Appl. No.: 17/423,132

(22) PCT Filed: Dec. 17, 2019

(86) PCT No.: PCT/DE2019/101099

§ 371 (c)(1),
(2) Date: Jan. 5, 2022

(87) PCT Pub. No.: WO2020/147882

PCT Pub. Date: Jul. 23, 2020

(65) Prior Publication Data

US 2022/0243620 A1 Aug. 4, 2022

(30) Foreign Application Priority Data

Jan. 16, 2019 (DE) ..... 10 2019 101 107.8

(51) Int. Cl.
*F01L 1/352* (2006.01)
*F01L 1/46* (2006.01)

(52) U.S. Cl.
CPC ..... *F01L 1/352* (2013.01); *F01L 1/46* (2013.01); *F01L 2001/3521* (2013.01); *F01L 2303/01* (2020.05); *F01L 2303/02* (2020.05)

(58) Field of Classification Search
CPC ..... F01L 1/352; F01L 2001/3521; F01L 1/46; F01L 2303/01; F01L 2303/02
USPC ..... 123/90.15
See application file for complete search history.

(56) References Cited

U.S. PATENT DOCUMENTS

| | | | | |
|---|---|---|---|---|
| 2011/0030631 | A1 | 2/2011 | David et al. | |
| 2011/0030632 | A1 | 2/2011 | David et al. | |
| 2016/0298506 | A1* | 10/2016 | Iwasaki | F01L 1/022 |
| 2017/0145873 | A1 | 5/2017 | Pluta et al. | |

FOREIGN PATENT DOCUMENTS

| | | | |
|---|---|---|---|
| CN | 107588177 | A | 1/2018 |
| CN | 109196192 | A | 1/2019 |
| DE | 102008022931 | A1 | 11/2009 |
| DE | 102008022932 | A1 | 11/2009 |
| DE | 102013204659 | A1 | 9/2014 |
| DE | 102016207930 | B3 | 8/2017 |
| DE | 102016204426 | A1 | 9/2017 |
| DE | 102009019397 | B4 | 11/2017 |

(Continued)

*Primary Examiner* — Jorge L Leon, Jr.

(57) ABSTRACT

A harmonic drive (1) comprises three connection elements (2, 9, 13), namely an input element (2), an output element (13) and an adjusting element (9), and an anti-twist mechanism (15) operates between the connection elements (2, 9, 13), the anti-twist mechanism comprising an anti-twist element (18), which is concentric to the connection elements (2, 9, 13) and interlockingly cooperates with one of the connection elements (9) and frictionally cooperates with one other connection element (2).

19 Claims, 2 Drawing Sheets

(56) References Cited

FOREIGN PATENT DOCUMENTS

| | | | | | |
|---|---|---|---|---|---|
| DE | 102016207927 | A1 | | 11/2017 | |
| DE | 102016216594 | B3 | | 11/2017 | |
| JP | 2009236042 | A | | 10/2009 | |
| JP | 2016200012 | A | | 12/2016 | |
| WO | WO-2017194046 | A1 | * | 11/2017 | ..... F01L 1/352 |
| WO | 2018095464 | A1 | | 5/2018 | |
| WO | 2018215009 | A1 | | 11/2018 | |

* cited by examiner

HARMONIC DRIVE

CROSS-REFERENCE TO RELATED APPLICATIONS

This application is the U.S. National Phase of PCT Application No. PCT/DE2019/101099 filed on Dec. 17, 2019, which claims priority to DE 10 2019 101 107.8 filed on Jan. 16, 2019, the entire disclosure of which is incorporated by reference herein.

TECHNICAL FIELD

This disclosure relates to a harmonic drive which is suitable for use as an adjusting gear of an electromechanical camshaft adjuster. The disclosure also relates to a method for securing a harmonic drive against misalignment, in particular during transport or during mounting.

BACKGROUND

A camshaft adjuster is known from DE 10 2016 216 594 B3, which can be secured against unintentional adjustment with the aid of an anti-rotation device. The anti-rotation device of the known camshaft adjuster comprises a spring which preloads the adjusting gear. The adjusting gear of the camshaft adjuster is designed as a harmonic drive with a flex ring as an elastic transmission element.

Further mechanisms with which an electromechanical camshaft adjuster can be secured against adjustment are known from the documents DE 10 2008 022 931 A1 and DE 10 2008 022 932 A1. In these cases, a swash plate transmission is provided as the adjusting gear of the camshaft adjuster.

A phase adjuster for internal combustion engines, that is to say a camshaft adjuster, with a locking element is known from DE 10 2009 019 397 B4. When this camshaft adjuster is in operation, the locking element remains in a parking position. A shift of the locking element from the locking position thereof into the parking position is possible by means of pressurized oil or pressurized air.

SUMMARY

The object of the disclosure is to provide a harmonic drive which is further developed compared to the prior art mentioned and which can be secured against unintentional adjustment, wherein a particularly easy handleability of the anti-rotation device is provided and encroachment on the structure of components of the harmonic drive are avoided as far as possible.

According to the disclosure, this object is achieved by a harmonic drive with the features described herein. The object is also achieved by a method for securing a harmonic drive against adjustment also described herein. The configurations and advantages of the disclosure explained below in connection with the securing method also apply analogously to the mechanism, i.e., the harmonic drive including the anti-rotation device, and vice versa.

In a basic concept known per se, the harmonic drive comprises three connection elements, namely an input element in the form of a housing which can be rotated as a whole, an output element to be connected to the shaft to be adjusted, in particular a camshaft, and an adjusting element. The anti-rotation mechanism operates between two of the three connection elements.

According to the disclosure, the anti-rotation device comprises an anti-rotation element which is concentric with all of the connection elements and interlockingly cooperates with one of the three connection elements and frictionally cooperates with a further connection element. It has been shown that both an anti-rotation device can be achieved and conventional harmonic drives can be secured against displacement, in particular during transport or mounting, without geometrical modification of any components.

In an example embodiment, the anti-rotation element is a securing ring, in particular made of plastic, which can be placed in such a way that it frictionally cooperates with the input element and interlockingly cooperates with the adjusting element.

In this case, an interlockingly acting anti-rotation contour can be formed on the side of the adjusting element by two bolts, which are firmly connected to an inner ring of a wave generator of the harmonic drive. The two bolts can be part of an Oldham coupling which, as a compensating coupling, compensates for an axial offset between the harmonic drive and an electric motor driving the adjusting element, that is to say the inner ring of the wave generator including bolts.

The securing ring can be produced efficiently by injection molding. In one embodiment, the securing ring is profiled in a U-shape. In this case, an interlockingly acting anti-twist contour, which cooperates directly with the bolts of the adjusting element, is formed by the securing ring through a corrugated, inner section of the U-profile of the securing ring. At the same time, the securing ring in this embodiment has a smooth, outer section of the U-profile, which is provided for frictional anti-rotation with respect to the input element, that is to say the housing of the harmonic drive.

A flange directed radially outward can be molded onto the U-profile described by the securing ring, which flange rests against an end face of the input element when the securing ring is inserted. For easier handling, a tab suitable for manual removal of the securing ring from the connection elements can be molded onto this flange.

The securing ring has the advantage that it can be placed between the named elements in any position of the adjusting element relative to the input element. The securing ring itself can also be in any desired angular position.

If, during the mounting of a camshaft adjuster, which includes the harmonic drive as an adjusting gear, the electric motor provided for actuating the harmonic drive is to be attached to the harmonic drive, a defined angular relationship between the input element and the output element of the harmonic drive can first be set and retained with the aid of the securing ring. The angular position of the adjusting element is irrelevant at this moment. Then the compensating coupling and the electric motor must be attached to the adjusting element. This is only possible after the securing ring has been removed from the harmonic drive, which can be done easily without tools. A mounting of the electric motor when the harmonic drive is locked is therefore ruled out due to the principle involved.

The securing ring, which works frictionally/interlockingly and which operates equally in every angular position of the elements to be fixed against each other, is also suitable for use in an automated production line.

In general, the method with which the harmonic drive is secured against adjustment is characterized in that a securing ring is inserted between the adjusting element and the housing of the harmonic drive in such a way that at the same time a frictional connection is made between the securing ring and the housing and an interlocking connection is made between the securing ring and the adjusting element.

The harmonic drive can be used not only as an electromechanical camshaft adjuster, but also in industrial applications, for example, in an industrial robot or in a machine tool.

BRIEF DESCRIPTION OF THE DRAWINGS

In the following, an exemplary embodiment of the disclosure is explained in more detail by means of a drawing. Herein.

DETAILED DESCRIPTION

Figure 1:
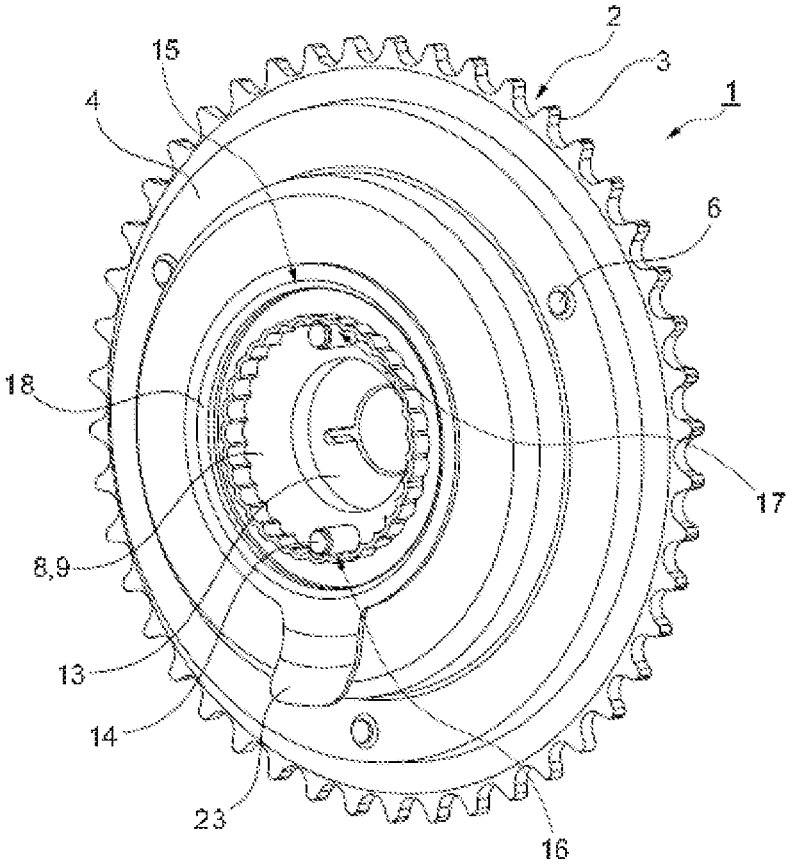
FIG. 1 shows a harmonic drive of an electric camshaft adjuster with an inserted securing ring in a perspective view.

A harmonic drive, identified overall by the reference numeral 1, is part of an electric camshaft adjuster, not further shown, which is used to adjust a camshaft of an internal combustion engine, namely a reciprocating piston engine, in relation to the crankshaft thereof. With regard to the principle function of the harmonic drive 1 including camshaft adjuster, reference is made to the prior art cited at the outset.

The harmonic drive 1 used as an adjusting gear is a triple-shaft gear. Three elements that are rotatable about a common axis, namely the axis of rotation of the camshaft, each directly interacting with external components, that is to say components not attributable to the harmonic drive 1, are generally referred to as connection elements 2, 9, 13. This involves an input element 2 designed as a housing, an adjusting element 9, and an output element 13 designed as a ring gear.

The input element 2 is constructed in several parts in the exemplary embodiment and comprises a sprocket 3 which is driven by the crankshaft when the camshaft adjuster is in operation, wherein it rotates at half the crankshaft speed. The output element 13 is provided for a non-rotatable connection to the camshaft to be adjusted. The adjusting element 9 is designed as an inner ring of a rolling bearing 8, which is part of a wave generator 7. The wave generator 7 is driven via a compensating coupling, namely an Oldham coupling, by an electric motor, not shown, for example a brushless synchronous motor. The compensating coupling has an Oldham disk, not shown, into which two bolts 14 engage when the camshaft adjuster is fully assembled. The bolts 14 are fastened in the above-mentioned rolling bearing inner ring and are assigned to the adjusting element 9.

As long as the adjusting element 9 rotates at the speed of the input element 2, the camshaft also rotates together with the output element 13 at this speed. A phase adjustment of the camshaft therefore does not take place in this operating state of the harmonic drive 1.

The outer contour of the adjusting element 9, which is designed as a rolling bearing ring, deviates from a circular shape. In a manner known per se, the adjusting element 9 forms a non-circular, elliptical raceway for rolling elements 10, namely balls. An associated outer ring 11 in which the balls 10 roll is designed to be flexible, in contrast to the adjusting element 9, so that it permanently adapts to the non-round shape of the adjusting element 9. The outer ring 11 is in turn surrounded by a flexible transmission element 12, which is externally toothed and is also referred to as a flex ring.

The external toothing of the flex ring 12 engages in internal toothing of the sprocket 3 and of the output element 13 at two diametrically opposite points. The sprocket 3 is firmly connected by screws 6 to a housing element 4, which is also assigned to the input element 2. Furthermore, the input element 2 is assigned a housing cover 5, which is located on the end face of the harmonic drive 1 facing the camshaft to be adjusted. The output element 13 is secured in the axial direction within the harmonic drive 1 by the housing cover 5. The housing element 4 serves to secure the outer ring 11 and thus the entire wave generator 7 in the opposite axial direction within the harmonic drive 1.

Different numbers of teeth in the toothing of the flex ring 12, the input element 2 and the output element 13 ensure, in a manner known per se, that a full rotation of the adjusting element 9 with respect to the input element 2 results in a comparatively small pivoting between the input element 2 and the output element 13 is implemented. Here, a coupling stage can be formed either between the flex ring 12 and the input element 2 or between the flex ring 12 and the output element 13. The transmission stage of the harmonic drive is accordingly formed either by the flex ring 12 and the output element 13 or between the flex ring 12 and the input element 2. In the former case, the harmonic drive 1 is a plus gear, in the latter case it is a minus gear.

Before the electric motor is mounted on the harmonic drive 1, it is initially blocked or rotationally locked or secured in a defined position. For this purpose, an anti-rotation device 15 is provided, which is formed on the one hand by two elements 2, 9, namely the input element 2 and the adjusting element 9, which are assigned to the connection elements of the harmonic drive 1, and on the other hand by a securing element 18 in the form of a securing ring.

The securing ring 18 frictionally cooperates with the input element 2 on the outside thereof and interlockingly cooperates with the adjusting element 9 on the inside thereof. In cross-section, the securing ring 18, which is a plastic part produced by injection molding, describes a U-profile 19.

An inner, corrugated section 20 is formed by the U-profile 19, which can be assigned to an interlocking anti-rotation device that can be produced between the adjusting element 9 and the securing ring 18. The interlocking anti-rotation device is made up of an inner anti-rotation contour 16 on the side of the adjusting element 9 and an outer anti-rotation contour 17 on the side of the securing ring 18. Here, the inner anti-rotation contour 16 is provided by parts that are already present in the harmonic drive 1, namely by the bolts 14. The associated outer anti-rotation contour 17 is in the form of the annularly closed, corrugated section 20 of the securing ring 18.

The corrugated section 20 is concentrically surrounded by an outer, smooth section 21, which is also formed by the U-profile 19 of the securing ring 18. In the exemplary embodiment, the outer, annular section 21 makes contact with a cylindrical inner circumferential surface of the housing element 4. In any case, the smooth section 21 is part of a frictionally acting anti-rotation device between the securing ring 18 and the input element 2.

Figure 2:
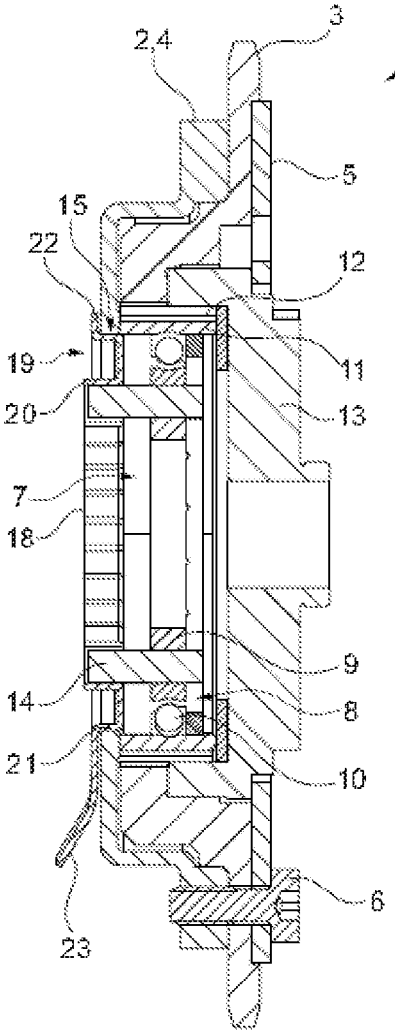
FIG. 2 shows sectional view of the arrangement according to FIG. 1.
Figure 3:
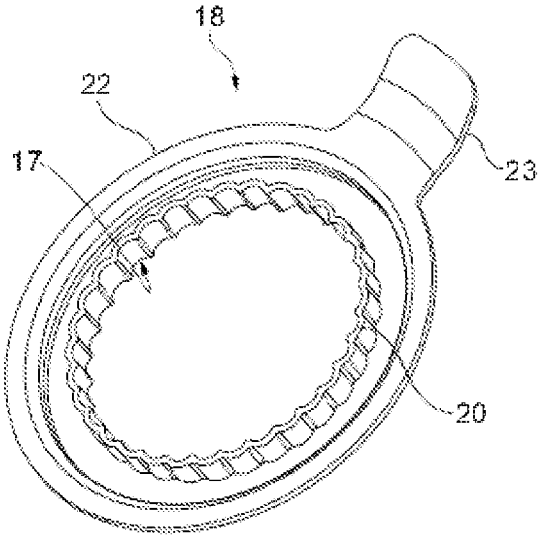
FIG. 3 shows a securing ring of the harmonic drive.

A radially outwardly directed flange 22 of the securing ring 18 adjoins the outer, cylindrical section 21. In the arrangement according to FIGS. 1 and 2, this flange 22 rests on the end face of the housing element 4. A tab 23 extending from the flange 22 can also be seen, which is used for the simple manual removal of the securing ring 18 from the harmonic drive 1. The attachment of the electric motor of the camshaft adjuster to the harmonic drive 1 is only possible with the securing ring 18 removed.

LIST OF REFERENCE CHARACTERS

1 Harmonic drive

2 Housing, input element

3 Sprocket
4 Housing element
5 Housing cover
6 Screw
7 Wave generator
8 Rolling bearing
9 Inner ring, adjusting element
10 Rolling element
11 Outer ring
12 Flex ring, flexible transmission element
13 Output ring gear, output element
14 Bolt
15 Anti-rotation device
16 Inner anti-rotation contour
17 Outer anti-rotation contour
18 Securing element, securing ring
19 U-profile
20 Inner, corrugated section
21 Outer, smooth section
22 Flange
23 Tab

The invention claimed is:

1. A harmonic drive comprising:
an input element,
an output element,
an adjusting element, and
an anti-rotation device including a securing ring configured to interlockingly cooperate with the adjusting element and frictionally cooperate with the input element so as to prevent rotation of the adjusting element relative to the input element.

2. The harmonic drive of claim 1, wherein the adjusting element includes:
a wave generator including an inner ring, and
at least one bolt secured to the inner ring, the at least one bolt forming a first interlocking anti-rotation contour.

3. The harmonic drive of claim 2, wherein the at least one bolt is a component of a compensating coupling.

4. The harmonic drive of claim 2, wherein the securing ring includes a U-shaped profile partially defined by a corrugated inner portion of the securing ring, the corrugated inner portion forming a second interlocking anti-rotation contour.

5. The harmonic drive of claim 4, wherein the U-shaped profile is further defined by a smooth outer portion of the securing ring, and
wherein the securing ring is configured to frictionally cooperate with the input element via the smooth outer portion.

6. The harmonic drive of claim 4, wherein a flange formed on the U-shaped profile engages the input element.

7. The harmonic drive of claim 6, wherein the securing ring is further configured to be manually removed from the harmonic drive via a tab extending from the flange.

8. A method for rotationally locking a harmonic drive, the method comprising:
providing the harmonic drive, the harmonic drive including:
a rotatable housing, and
a wave generator including an adjusting element,
providing a securing ring configured as a rotational lock, and
inserting the securing ring between the adjusting element and the housing such that frictional cooperation between the securing ring and the housing, and an interlocking cooperation between the securing ring and the adjusting element prevent rotation of the adjustment element relative to the housing.

9. The method of claim 8, further comprising:
removing the securing ring from the harmonic drive, and
attaching an electric motor to the adjusting element.

10. A harmonic drive comprising:
a housing,
a wave generator including an outer ring and an inner ring forming a raceway,
a plurality of balls arranged between the inner ring and the outer ring,
an externally toothed flex ring arranged around the outer ring,
an output gear configured to engage with the externally toothed flex ring, and
a removable securing ring configured to interlock with the inner ring and to frictionally engage the housing so as to prevent rotation of the inner ring relative to the housing.

11. The harmonic drive of claim 10, wherein the securing ring is further configured to be removed from the harmonic drive via a tab of the securing ring.

12. The harmonic drive of claim 10, wherein the raceway is an elliptical raceway.

13. The harmonic drive of claim 10, wherein an outer annular portion of the securing ring frictionally engages an inner circumferential surface of the housing.

14. The harmonic drive of claim 10, wherein the securing ring interlocks with the inner ring via a corrugated portion of the securing ring.

15. The harmonic drive of claim 14, wherein the corrugated portion engages at least one bolt arranged on the inner ring.

16. The harmonic drive of claim 14, wherein the corrugated portion extends 360 degrees.

17. The harmonic drive of claim 10, wherein the securing ring includes:
an outer annular portion configured to frictionally engage an inner circumferential surface of the housing, and
a corrugated portion configured to interlock with the inner ring.

18. The harmonic drive of claim 17, wherein the corrugated portion is concentrically surrounded by the outer annular portion.

19. The harmonic drive of claim 17, wherein the outer annular portion and the corrugated portion define a U-shaped profile of the securing ring.

* * * * *